US009858841B2

(12) United States Patent
Nishimura

(10) Patent No.: US 9,858,841 B2
(45) Date of Patent: Jan. 2, 2018

(54) CIRCUIT DEVICE, ELECTRO-OPTICAL DEVICE, AND ELECTRONIC APPARATUS

(71) Applicant: SEIKO EPSON CORPORATION, Tokyo (JP)

(72) Inventor: Motoaki Nishimura, Chino (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 15/040,665

(22) Filed: Feb. 10, 2016

(65) Prior Publication Data

US 2016/0240130 A1 Aug. 18, 2016

(30) Foreign Application Priority Data

Feb. 17, 2015 (JP) ..... 2015-028246

(51) Int. Cl.
*G09G 1/00* (2006.01)
*G09G 3/00* (2006.01)

(52) U.S. Cl.
CPC ..... *G09G 3/006* (2013.01); *G09G 2330/021* (2013.01); *G09G 2330/028* (2013.01); *G09G 2330/04* (2013.01); *G09G 2330/12* (2013.01)

(58) Field of Classification Search
CPC ..... G09G 2330/00–2330/12
See application file for complete search history.

(56) References Cited

U.S. PATENT DOCUMENTS

2006/0214599 A1* 9/2006 Ogawa ..... H02M 1/32 315/169.4
2006/0238478 A1* 10/2006 Lin ..... G09G 3/20 345/98
2008/0036357 A1* 2/2008 Cho ..... G09G 3/22 313/495
2012/0044273 A1* 2/2012 Park ..... G09G 3/20 345/690
2013/0082910 A1* 4/2013 Lee ..... G09G 3/3208 345/76
2014/0084792 A1* 3/2014 Oh ..... H05B 37/02 315/120
2014/0362072 A1* 12/2014 Park ..... G09G 3/006 345/212

FOREIGN PATENT DOCUMENTS

JP 2007-212897 A 8/2007
JP 2010-145738 A 7/2010

* cited by examiner

*Primary Examiner* — Sanghyuk Park
(74) *Attorney, Agent, or Firm* — Oliff PLC

(57) ABSTRACT

A driver includes a power supply circuit having first to n-th boost circuits, a circuit that operates based on power supplied from the power supply circuit, and an abnormality detection circuit. The abnormality detection circuit detects an abnormality of an i-th boosted voltage that is generated based on a boost operation of an i-th boost circuit. If an abnormality of the i-th boosted voltage is detected, a j-th boost circuit performs a low-capacity boost operation with a lower current-supply capacity than an ordinary boost operation or stops the boost operation.

16 Claims, 13 Drawing Sheets

CIRCUIT DEVICE, ELECTRO-OPTICAL DEVICE, AND ELECTRONIC APPARATUS

BACKGROUND

1. Technical Field

The present invention relates to a circuit device, an electro-optical device, an electronic apparatus, and the like.

2. Related Art

Display drivers that drive display panels require various kinds of voltages such as, for example, a power supply for a source driving amplifier, a power supply for a gate driving amplifier, a power supply for a gradation voltage generation circuit, a common voltage for a display panel, and the like, and thus incorporate power supply circuits that generate the required voltages. For example, JP-A-2007-212897 and JP-A-2010-145738 disclose a display driver including a power supply circuit having a plurality of boost circuits (primary to quaternary boost circuits) as well as a source driver and a gate driver that are operated with power supplies generated by boost operations of the boost circuits of the power supply circuit.

In a display driver in which a power supply for driving is generated by the boost operations as described above, noise, data corruption of register values, and the like cause a large current to flow through a parasitic bipolar or the like of a boost circuit. Thus, malfunction of the power supply occurs, making it impossible for the boost operation of the boost circuit to recover to a normal state.

With regard to display drivers for portable apparatuses, even if such malfunction of the power supply occurs, the malfunction of the power supply can be eliminated by a user turning off a power switch of a portable apparatus, for example, and thus the normal state can be recovered. However, with regard to display drivers for automobile applications, the power supplied to a display driver cannot be turned off unless an engine is shut off, for example, and thus recovery from malfunction of the power supply is difficult.

SUMMARY

According to some aspects of the invention, it is possible to provide a circuit device that is capable of detecting an abnormality of a boosted voltage generated by a boost circuit and allowing a boost operation of the boost circuit to recover to a normal state, as well as an electro-optical device, an electronic apparatus, and the like.

An aspect of the invention is directed to a circuit device including a power supply circuit having first to n-th boost circuits, "n" being an integer of $n \geq 2$, a circuit that operates based on power supplied from the power supply circuit, and an abnormality detection circuit, wherein the abnormality detection circuit detects an abnormality of an i-th boosted voltage that is generated based on a boost operation of an i-th boost circuit of the first to n-th boost circuits, "i" being an integer of $1 \leq i \leq n$, and if an abnormality of the i-th boosted voltage is detected, a j-th boost circuit of the first to n-th boost circuits performs a low-capacity boost operation with a lower current-supply capacity than an ordinary boost operation or stops the boost operation, "j" being an integer of $1 \leq j \leq n$ and $j \neq i$.

According to this aspect of the invention, the abnormality detection circuit detects an abnormality of the i-th boosted voltage, thereby enabling self-detection of an abnormality of a boosted voltage by the circuit device. If an abnormality of the i-th boosted voltage is detected, the j-th boost circuit that is different from the i-th boost circuit performs the low-capacity boost operation or stops the boost operation. Thus, the i-th boosted voltage can recover to a normal voltage, and the boost operation of the boost circuit can recover to a normal state.

Moreover, according to an aspect of the invention, it is also possible that the j-th boost circuit performs the low-capacity boost operation or stops the boost operation during a period of time for which an abnormality of the i-th boosted voltage is detected, and resumes the ordinary boost operation if the abnormality of the i-th boosted voltage is no longer detected.

If the i-th boosted voltage recovers to normal, the abnormality is no longer detected, which can trigger resumption of the ordinary boost operation by the j-th boost circuit, so that the operation and the boosted voltage of the boost circuit can recover to the ordinary state. In this manner, the circuit device is capable of self-recovery from a power supply abnormality.

Moreover, according to an aspect of the invention, it is also possible that the i-th boosted voltage is a substrate voltage of the circuit device, and the abnormality detection circuit detects an abnormality of the substrate voltage.

For example, if the substrate is a P-type substrate, the substrate voltage is the lowest voltage, and thus when a power supply abnormality occurs, the current flowing through a parasitic bipolar is highly likely to finally flow into the substrate. At this time, the substrate voltage increases. Therefore, an abnormality of the substrate voltage can be detected by detecting the increase in the substrate voltage.

Moreover, according to an aspect of the invention, it is also possible that the j-th boost circuit is a boost circuit having a highest current-supply capacity among the first to n-th boost circuits.

Malfunction of the power supply refers to a state in which the on state of a parasitic bipolar is maintained, and requires the supply of a current that is large enough to maintain the on state to the parasitic bipolar. For this reason, it is sufficient if the boost operation of a boost circuit having a current-supply capacity that is high enough to maintain an on state of a parasitic bipolar is switched to the low-capacity operation or stopped.

Moreover, according to an aspect of the invention, it is also possible that the i-th boosted voltage is a voltage that is generated based on a j-th boosted voltage that is generated based on the boost operation of the j-th boost circuit.

Moreover, according to an aspect of the invention, it is also possible that the j-th boost circuit performs the low-capacity boost operation if an abnormality of the i-th boosted voltage is detected, and resumes the ordinary boost operation if the abnormality of the i-th boosted voltage is no longer detected If an abnormality of the i-th boosted voltage is detected, the j-th boost circuit performs the low-capacity boost operation and can thus generate the j-th boosted voltage. In the case where the i-th boosted voltage is generated based on the j-th boosted voltage, the generation of the j-th boosted voltage allows generation of the i-th boosted voltage, and therefore self-recovery from the power supply abnormality is possible.

Moreover, according to an aspect of the invention, it is also possible that the i-th boosted voltage is a voltage that is generated based on a k-th boosted voltage that is generated based on a boost operation of a k-th boost circuit of the first to n-th boost circuits, "k" being an integer of $1 \leq k \leq n$ and $k \neq i$, j, and the j-th boost circuit stops the boost operation if an abnormality of the i-th boosted voltage is detected.

In the case where the i-th boosted voltage is generated based on the k-th boosted voltage that is different from the j-th boosted voltage, self-recovery of the i-th boosted voltage is possible even when the boost operation of the j-th boost circuit is stopped. It should be noted that even in such a case, the j-th boost circuit may perform the low-capacity boost operation if an abnormality of the i-th boosted voltage is detected.

Moreover, according to an aspect of the invention, it is also possible that the circuit is a drive circuit that drives a display panel based on the j-th boosted voltage that is generated based on the boost operation of the j-th boost circuit.

Since driving of a display panel involves large current consumption, the j-th boosted voltage has a high current-supply capacity. Recovery from a power supply abnormality can be achieved by this j-th boost circuit, which can be a current source for a parasitic bipolar, performing the low-capacity boost operation or stopping the boost operation.

Moreover, according to an aspect of the invention, it is also possible that the j-th boost circuit has a boost transistor for the ordinary boost operation and a boost transistor for soft start, and in the low-capacity boost operation, the j-th boost circuit performs the boost operation using the boost transistor for soft start.

The soft start operation is a boost operation that is performed with a reduced current-supply capacity so as to suppress inrush current. Thus, if an abnormality of the i-th boosted voltage is detected, the j-th boost circuit can perform the low-capacity boost operation by performing the boost operation using the boost transistor for soft start.

Moreover, according to an aspect of the invention, it is also possible that the j-th boost circuit includes first to fourth transistors that are connected in series as well as fifth and sixth transistors that are connected to the third and fourth transistors of the first to fourth transistors in parallel, and in the ordinary boost operation, the j-th boost circuit performs the boost operation by turning on and off the first to fourth transistors, and in the low-capacity boost operation, the j-th boost circuit turns off the third and fourth transistors and performs soft start of the boost operation using the first and second transistors and the fifth and sixth transistors.

With this configuration, the boost transistor for the ordinary boost operation can be constituted by the third and fourth transistors, and the boost transistor for soft start can be constituted by the fifth and sixth transistors.

Moreover, according to an aspect of the invention, it is also possible that the abnormality detection circuit detects that the i-th boosted voltage is abnormal if the i-th boosted voltage exceeds a detection voltage.

An increase in the i-th boosted voltage due to a power supply abnormality can be detected by detecting that the i-th boosted voltage exceeds the detection voltage. For example, in the case where the i-th boosted voltage is the substrate voltage, an increase in the substrate voltage can be detected.

Moreover, according to an aspect of the invention, it is also possible that the detection voltage has hysteresis characteristics.

A detection voltage having hysteresis characteristics can suppress repetition of an inversion of normality and abnormality with respect to the abnormality detection result when the i-th boosted voltage is near the detection voltage.

Moreover, according to an aspect of the invention, it is also possible that the abnormality detection circuit has a detection transistor that is provided between a node for a first power supply voltage and a node for the i-th boosted voltage and to whose gate is input an input voltage based on a second power supply voltage, the first power supply voltage being one of a high potential-side power supply voltage and a low potential-side power supply voltage and the second power supply voltage being the other of the high potential-side power supply voltage and the low potential-side power supply voltage, and the abnormality detection circuit detects an abnormality of the i-th boosted voltage based on a voltage change at one of a source and a drain of the detection transistor.

Providing the detection transistor TDET between the node for the first power supply voltage, which is not a boosted voltage, and the node for the i-th boosted voltage and inputting the input voltage VNB1 based on the second power supply voltage, which is not a boosted voltage, to the gate of the detection transistor TDET makes it possible to accurately detect an abnormality of the i-th boosted voltage when a boosted voltage abnormality occurs.

Moreover, another aspect of the invention is directed to an electro-optical device including the circuit device according to any of the foregoing aspects and a display panel, wherein the circuit is a drive circuit that drives the display panel based on the power supplied from the power supply circuit.

Moreover, still another aspect of the invention is directed to an electronic apparatus including the circuit device according to any of the foregoing aspects.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
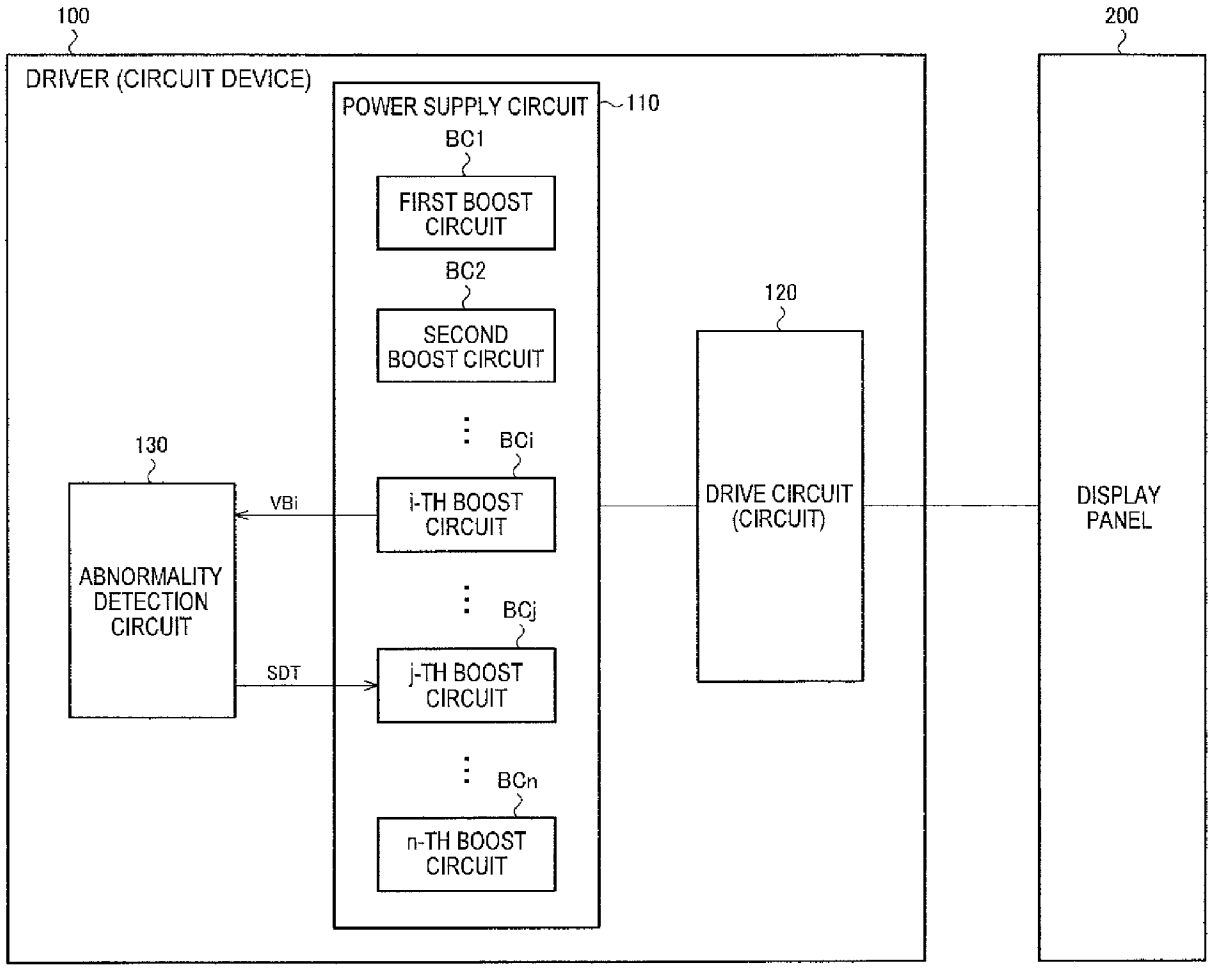
FIG. 1 shows a first configuration example of a driver.

The following describes preferred embodiments of the invention in detail. It should be noted that the embodiments to be described hereinafter are not intended to unduly limit the subject matter of the invention as set forth in the claims and that not all of the configurations to be described in the embodiments are necessarily essential as the means for achieving the invention. For example, although a case in which a circuit device is a driver is taken as an example in the following description, the invention is applicable to any circuit device that includes a power supply circuit having a boost circuit.

1. First Configuration Example

As described above, a driver that drives a display panel generates a plurality of voltages using a power supply circuit and causes circuits such as a source driver to operate with the plurality of voltages. As will be described later with reference to FIGS. 10 and 11, for example, a power supply circuit 110 of a driver 100 generates power supply voltages VDDHSP and VDDHSN for a source driver 120, a common voltage VCOM, and the like from system power supply voltages VDD and VSS supplied from a system power supply 210.

These voltages are supplied to nodes of transistors and substrates (i.e., P-type and N-type diffusion layers and the like) in the individual circuits, but as long as the voltages maintain a predetermined magnitude relationship, a PN junction within a substrate is reverse biased, and thus no parasitic bipolar turns on. However, there are cases where if the magnitude relationship of the voltages breaks down for some reason, a parasitic bipolar turns on, and a current path is established between nodes to which voltages generated by the power supply circuit are applied. If such a current path is maintained, the voltage on the side from which the current is drawn decreases, and the voltage on the side into which the current flows increases. This results in a situation that is stuck in a state in which voltages generated by the power supply circuit are not predetermined voltages.

For example, noise, data corruption of register values, and the like are conceivable as factors that turn on a parasitic bipolar. For example, in the case of automobile applications, there is very much noise in the environment due to the presence of a noise source such as an engine. It is envisaged that if such noise is superimposed on a voltage generated by the power supply circuit of the driver, that noise turns on a parasitic bipolar, thus causing malfunction of the power supply. Also, if noise or the like causes data corruption of register values, a setting of the power supply circuit is changed to such a setting that would not occur under ordinary usage conditions, and thus there is a possibility that the PN junction may be forward biased. For example, when turning off the power supply of the driver, charges of capacitors holding the respective voltages generated by the power supply circuit are shorted and discharged to the ground. When the driver is performing an ordinary operation, if data corruption of a register value that instructs the discharge occurs, a part of the voltages generated by the power supply circuit is shorted to the ground. There is a possibility that this may cause the magnitude relationship of the voltages to break down, resulting in malfunction of the power supply.

FIG. 1 shows a first configuration example of a driver that is capable of detection of an abnormality of a power supply such as those described above and self-recovery to a normal state.

A driver 100 in FIG. 1 includes a power supply circuit 110 having first to n-th boost circuits BC1 to BCn ("n" is an integer of n 2), a drive circuit 120 (circuit in a broad sense) that operates based on power supplied from the power supply circuit 110, and an abnormality detection circuit 130.

The abnormality detection circuit 130 detects an abnormality of an i-th boosted voltage VBi that is generated based on the boost operation of an i-th boost circuit BCi ("i" is an integer of $1 \leq i \leq n$). If an abnormality of the i-th boosted voltage VBi is detected, a j-th boost circuit BCj ("j" is an integer of $1 \leq j \leq n$ and $j \neq i$) performs a low-capacity boost operation with a lower current-supply capacity than an ordinary boost operation or stops the boost operation.

Specifically, the power supply circuit 110 generates a plurality of power supplies based on first to n-th boosted voltages VB1 to VBn generated by the first to n-th boost circuits BC1 to BCn. For example, the power supply circuit 110 may further include a plurality of regulators that regulate the boosted voltages VB1 to VBn generated by the first to n-th boost circuits BC1 to BCn. Then, outputs of the plurality of regulators or the first to n-th boosted voltages are output as the power supplies.

Each of the first to n-th boost circuits BC1 to BCn may be a charge pump circuit that performs the boost operation by a switched capacitor operation, for example. Alternatively, each boost circuit may be a switching regulator that performs the boost operation by performing PWM driving of an inductor. Each boost circuit generates a boosted voltage by boosting a system voltage supplied from the outside of the driver 100, a boosted voltage generated by a boost circuit other than itself, or an output of the corresponding regulator. "Boost" as used herein not only refers to generation of a positive (or negative) boosted voltage having the same sign as an input positive (or negative) voltage but also includes generation of a negative (or positive) boosted voltage having the reverse sign of an input positive (or negative) voltage.

The abnormality detection circuit 130 detects that the i-th boosted voltage VBi is a non-normal (abnormal) voltage, and outputs a detection signal SDT to this effect to the j-th boost circuit BCj. For example, it can be considered that in a normal state the i-th boosted voltage VBi is within a predetermined voltage range, and so when the i-th boosted voltage VBi is outside the predetermined voltage range (e.g., equal to or higher than a predetermined voltage as will be described later), this state is detected as a non-normal state (abnormal state). If the detection signal SDT becomes active, the j-th boost circuit BCj performs the low-capacity boost operation or stops the boost operation.

The low-capacity boost operation is a boost operation that is performed with a reduced current-supply capacity with respect to the load. That is to say, when the maximum value of an output current that allows a boost circuit to maintain the boosted voltage at a specified voltage is regarded as the current-supply capacity, the maximum output current with which the boosted voltage can be maintained at the specified voltage in the low-capacity boost operation is lower than that in an ordinary boost operation. For example, in the case of a charge pump circuit, the current-supply capacity can be changed by changing the size (on-resistance) of a switch element of a switched capacitor. For example, the low-capacity boost operation can be realized by a boost operation that is performed by transistors for soft start in FIG. 4. It should be noted that the ordinary boost operation refers to an operation that is performed with the original current-supply capacity of a boost circuit and may be, for example, a boost operation that is performed by transistors for the ordinary boost operation, of a boost circuit in FIG. 4.

Stopping of the boost operation means a state in which a boost circuit does not perform the boost operation, that is, a state in which a charge pump circuit or a switching regulator, for example, stops its switching operation. In this state, the switching operation is stopped in any phase of a plurality of phases that are repeated in the switching operation, or the output of the boost circuit is set to a high impedance state.

As described above, the detection of an abnormality of the i-th boosted voltage VBi by the abnormality detection circuit 130 allows self-detection of an abnormality of a boosted voltage by the driver 100. If the abnormality detection circuit 130 detects an abnormality of the i-th boosted voltage VBi, the j-th boost circuit BCj performs the low-capacity boost operation or stops the boost operation, thereby enabling the recovery to the normal state of the boosted voltage.

That is to say, malfunction of the power supply occurs because a current flows between power supplies generated by the power supply circuit 110 via a parasitic bipolar in the substrate of the driver 100. Since the power supply circuit 110 generates a power supply voltage based on the boosted voltages, the source of the current flowing through the parasitic bipolar is a boost circuit. The on state of the parasitic bipolar is maintained as long as a sufficient current is supplied to the parasitic bipolar. For this reason, the on state of the parasitic bipolar can be terminated by the boost circuit that constitutes the source of the current performing the low-capacity boost operation or stopping the boost operation, and thus malfunction of the power supply can be eliminated.

2. Second and Third Configuration Examples

Figure 2A:
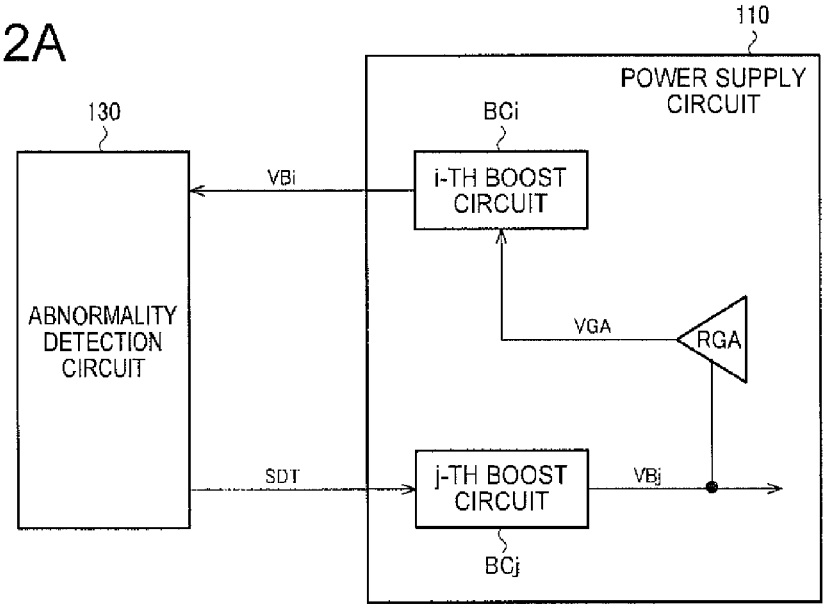
FIG. 2A shows a second configuration example of the driver.
Figure 2B:
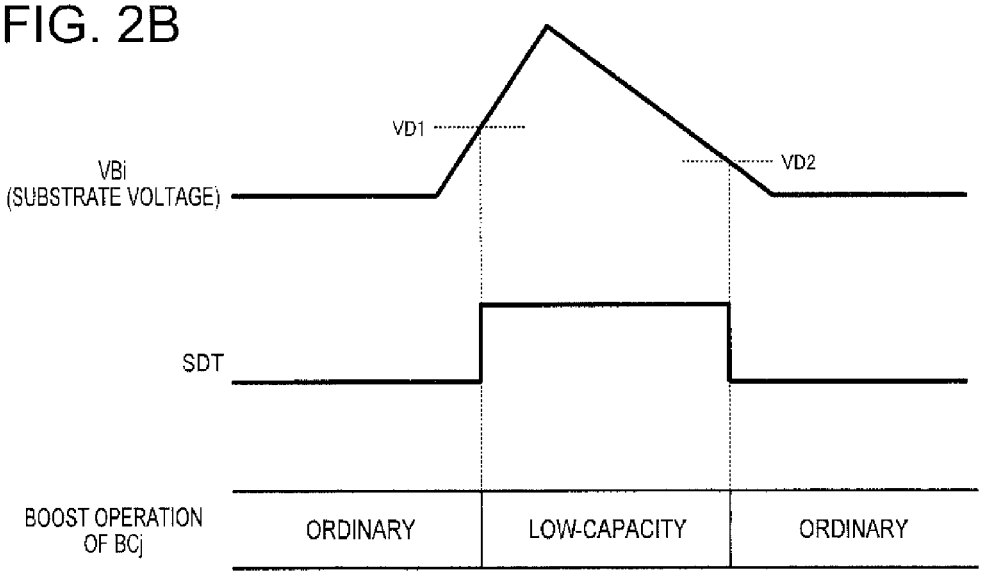
FIG. 2B is a timing chart of the second configuration example of the driver.
Figure 3A:
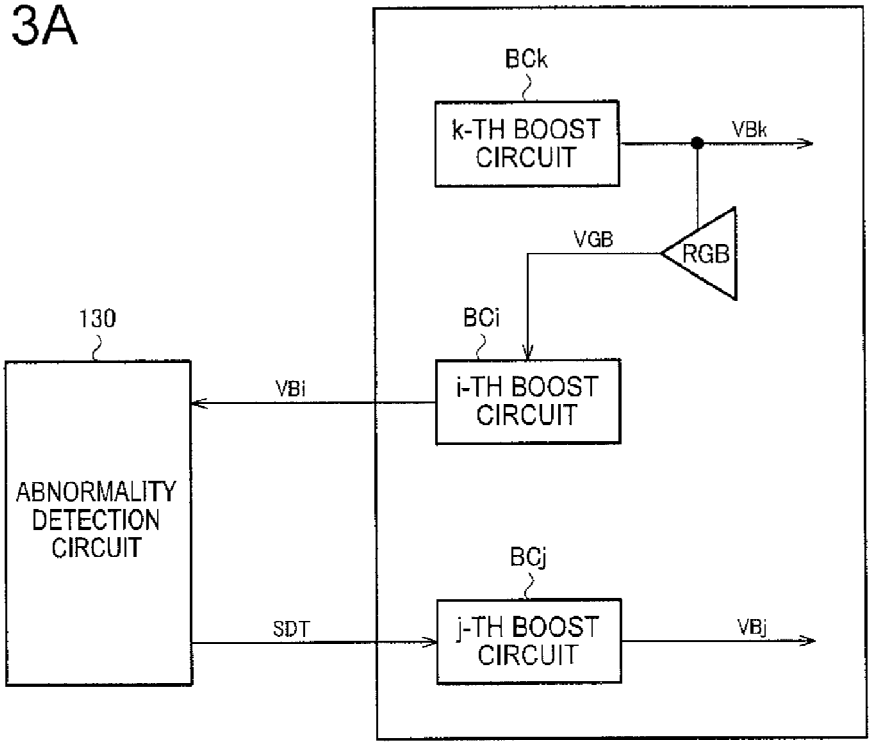
FIG. 3A shows a third configuration example of the driver.

FIGS. 2A and 3A show second and third configuration examples, respectively, of the driver 100. It should be noted that apart of the boost circuits and the drive circuit 120 are not shown in FIGS. 2A and 3A. Also, FIGS. 2B and 3B show timing charts of the second and third configuration examples, respectively.

Figure 3B:
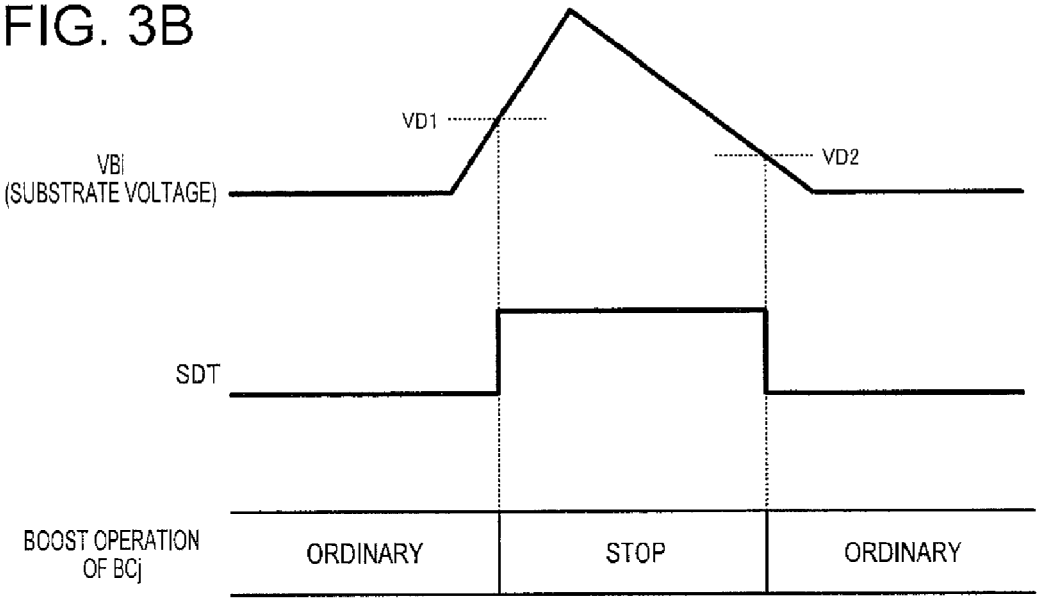
FIG. 3B is a timing chart of the third configuration example of the driver.

As shown in FIGS. 2B and 3B, the j-th boost circuit BCj performs the low-capacity boost operation or stops the boost operation during a period of time for which an abnormality of the i-th boosted voltage VBi is detected, and resumes the ordinary boost operation if the abnormality of the i-th boosted voltage VBi is no longer detected.

In the examples in FIGS. 2B and 3B, the period of time for which an abnormality of the i-th boosted voltage VBi is detected corresponds to the period of time for which the detection signal SDT is at a high level (active), and the time when the abnormality of the i-th boosted voltage VBi is no longer detected corresponds to the time when the detection signal SDT changes from the high level to a low level (inactive).

As described above, according to the present embodiment, the i-th boosted voltage can recover to the normal state by the j-th boost circuit BCj performing the low-capacity boost operation or stopping the boost operation. Once the i-th boosted voltage recovers to the normal state, the abnormality is no longer detected. This can trigger resumption of the ordinary boost operation by the j-th boost circuit BCj, thus causing the operation of the boost circuit and the boosted voltage to recover to the ordinary state. This recovery operation is completed within the driver 100 and does not require any operation such as turning off of a power switch by the user. For example, in the case of automobile applications, it is sometimes difficult to stop the vehicle and shut off the engine even when an abnormality of the power supply of the driver 100 occurs, and thus the capability of self-recovery from a power supply abnormality and restoration of the display is desirable.

Moreover, according to the present embodiment, the i-th boosted voltage VBi is a substrate voltage of the driver 100. The abnormality detection circuit 130 detects an abnormality of the substrate voltage.

That is to say, the driver 100 is configured by an integrated circuit device, and the voltage that is set in a semiconductor substrate of the integrated circuit device is the substrate voltage. For example, if the semiconductor substrate is a P-type substrate, the lowest voltage of the power supply voltages generated by the power supply circuit 110 is set as the substrate voltage. For example, in the case of a power supply circuit in FIG. 10, which will be described later, a voltage VEE generated by a boost circuit BC4 is the substrate voltage.

If the semiconductor substrate is a P-type substrate, the substrate voltage is the lowest voltage, and thus the current that flows through the parasitic bipolar when a power supply abnormality occurs is highly likely to finally flow into the substrate. If such an abnormal current flows into the substrate, the substrate voltage increases. Thus, an abnormality of the substrate voltage can be detected by detecting the substrate voltage.

Specifically, as shown in FIGS. 2B and 3B, if the i-th boosted voltage VBi exceeds a detection voltage VD1, the abnormality detection circuit 130 detects that the i-th boosted voltage VBi is abnormal. This detection voltage has hysteresis characteristics. That is to say, a detection voltage VD2 (<VD1) that is different from the detection voltage VD1 is used to determine whether the abnormality is no longer detected.

In this manner, an increase in the substrate voltage due to malfunction of the power supply can be detected by detecting that the i-th boosted voltage VBi exceeds the detection voltage VD1. It can be considered that in an ordinary operating state (i.e., state in which the power supplies generated by the power supply circuit 110 are normal), the i-th boosted voltage VII fluctuates within a predetermined range. Thus, the detection voltage VD1 is set to be outside that predetermined range. Alternatively, if the voltage that the i-th boosted voltage VBi becomes when malfunction of the power supply occurs is known (e.g., experimentally known), the detection voltage VD1 is set at that voltage in advance.

In the second configuration example shown in FIG. 2A, the i-th boosted voltage VBi is a voltage that is generated based on the j-th boosted voltage VBj that is generated based on the boost operation of the j-th boost circuit BCj. Moreover, as shown in FIG. 2B, the j-th boost circuit BCj performs the low-capacity boost operation if an abnormality of the i-th boosted voltage VBi is detected, and resumes the ordinary boost operation if the abnormality of the i-th boosted voltage VBi is no longer detected.

Specifically, the power supply circuit 110 includes the i-th boost circuit BCi, the j-th boost circuit BCj, and a regulator RGA. The regulator RGA generates a voltage VGA from the j-th boosted voltage VBj, and the i-th boost circuit BCi boosts the voltage VGA to generate the i-th boosted voltage VBi. The regulator RGA may be a linear regulator, for example, and regulates the j-th boosted voltage VBj to the voltage VGA that is obtained by multiplying a reference voltage by a predetermined factor. For example, in the power supply circuit shown in FIG. 10, which will be described later, a first boost circuit BC1 corresponds to the j-th boost circuit BCj, a regulator RG8 corresponds to the regulator RGA, and a fourth boost circuit BC4 corresponds to the i-th boost circuit BCi.

With this configuration, in order for the i-th boosted voltage VBi to recover from the abnormal state, the output voltage VGA of the regulator RGA is necessary. That is to say, generation of the j-th boosted voltage VBj, which is the input voltage of the regulator RGA, is necessary. For this reason, according to the configuration in FIG. 2A, in the abnormal state the j-th boost circuit BCj performs the low-capacity operation rather than stopping the boost operation. Thus, even in the abnormal state, the output voltage VGA of the regulator RGA is supplied to the i-th boost circuit BCi. This allows the malfunction of the power supply to be eliminated and the i-th boosted voltage VBi to self-recover to a normal voltage.

In the third configuration example shown in FIG. 3A, the i-th boosted voltage VBi is a voltage that is generated based on a k-th boosted voltage VBk ("k" is an integer of $1 \leq k \leq n$ and $k \neq i, j$) that is generated based on the boost operation of a k-th boost circuit. Moreover, as shown in FIG. 3B, if an abnormality of the i-th boosted voltage VBi is detected, the j-th boost circuit BCj stops the boost operation.

Specifically, the power supply circuit 110 includes the i-th boost circuit BCi, the j-th boost circuit BCj, the k-th boost circuit BCk, and a regulator RGB. The regulator RGB generates a voltage VGB from the k-th boosted voltage VBk, and the i-th boost circuit BCi boosts the voltage VGB to generate the i-th boosted voltage VBi. The regulator RGB may be a linear regulator, for example, and regulates the k-th boosted voltage VBk to the voltage VGB that is obtained by multiplying a reference voltage by a predetermined factor. For example, in the power supply circuit shown in FIG. 10, which will be described later, second and third boost circuits BC2 and BC3 correspond to the j-th boost circuit BCj, the first boost circuit BC1 corresponds to the k-th boost circuit BCk, the regulator RG8 corresponds to the regulator RGB, and the fourth boost circuit BC4 corresponds to the i-th boost circuit BCi.

With this configuration, even if the j-th boosted voltage VBj is not generated, the i-th boosted voltage VBi can recover from the abnormal state. For this reason, according to the configuration in FIG. 3A, in the abnormal state the j-th boost circuit BCj stops the boost operation. Thus, in the abnormal state the j-th boosted voltage VBj is no longer generated. However, as long as the i-th boost circuit BCi is in a state in which it can generate the i-th boosted voltage VBi, self-recovery from the malfunction of the power supply is possible.

Moreover, according to the present embodiment, the j-th boost circuit BCj is a boost circuit that has the highest current-supply capacity among the first to n-th boost circuits BC1 to BCn.

Malfunction of the power supply, which refers to a state in which the on state of a parasitic bipolar is maintained, requires the supply of a current that is large enough to maintain the on state to the parasitic bipolar. For this reason, it can be considered that with the output of a boost circuit having a low current-supply capacity, even if a parasitic bipolar turns on, this on state is automatically terminated. Thus, it is sufficient if the boost operation of a boost circuit having a current-supply capacity that is high enough to maintain the on state of the parasitic bipolar is switched to the low-capacity operation or stopped.

Figure 10:
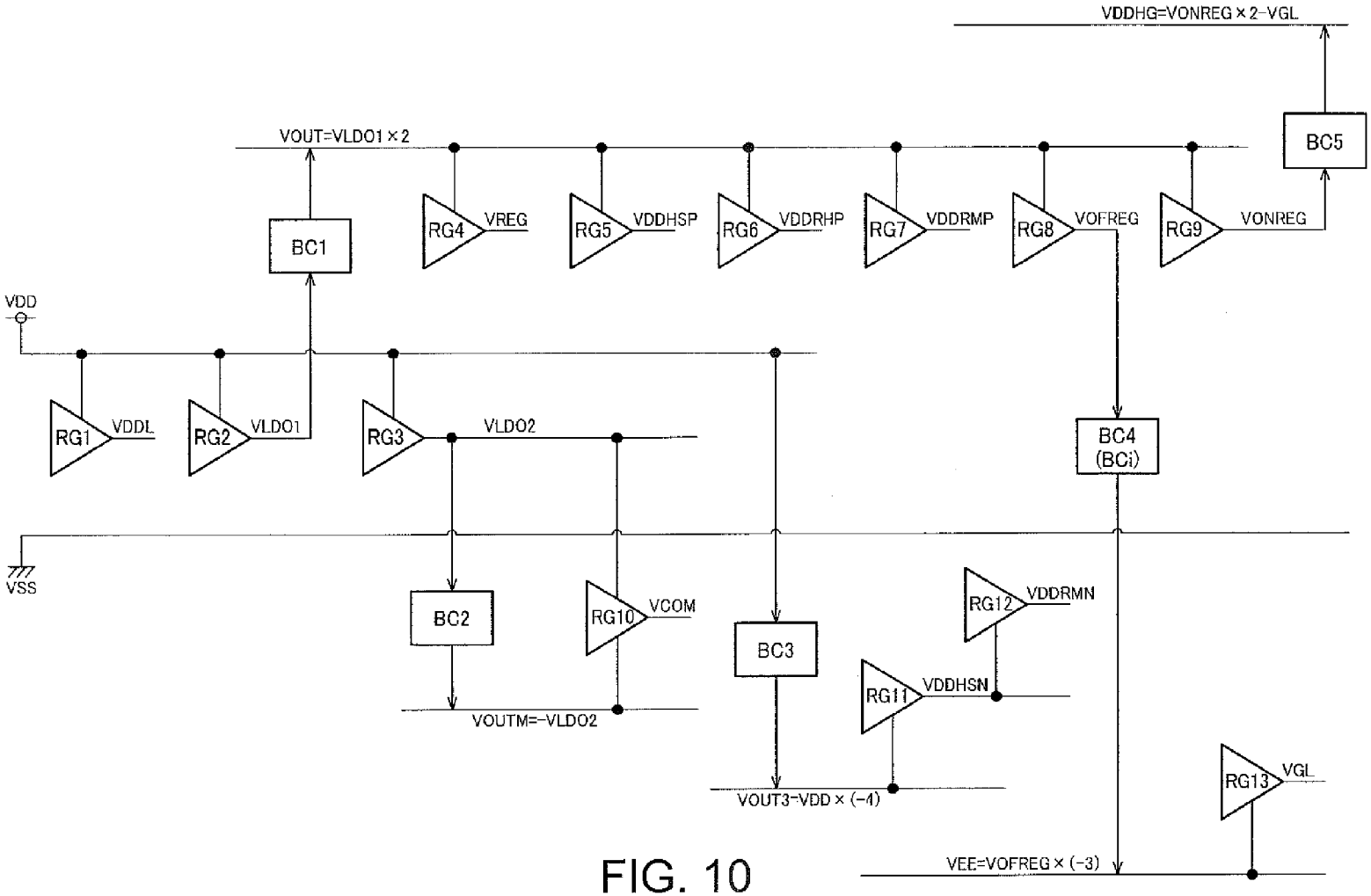
FIG. 10 shows a detailed configuration example of a power supply circuit.

For example, in the power supply circuit in FIG. 10, the first boost circuit BC1 is the boost circuit having the highest current-supply capacity. With respect to the first boost circuit BC1, a plurality of regulators and a boost circuit are provided as a downstream circuit, and it is required to supply output current of and consumed current in those regulators and the boost circuit. For this purpose, the first boost circuit BC1 has the highest current-supply capacity. Even when a parasitic bipolar downstream of the regulators and the boost circuit that are provided downstream of the first boost circuit BC1 turns on, recovery from the malfunction of the power supply can be achieved by reducing or stopping the current supply from the first boost circuit BC1, which is the upstream current source.

Moreover, according to the present embodiment, the drive circuit 120 drives a display panel 200 (electro-optical panel) based on the j-th boosted voltage VBj that is generated based on the boost operation of the j-th boost circuit BCj.

The drive circuit 120 is a source driver that drives a source line of a display panel. The source driver is required to drive a pixel capacitor at high speed and is thus a circuit whose current consumption is especially large in the driver 100. For this reason, in the case where the power supply for the drive circuit 120 is generated based on the j-th boosted voltage VBj, the j-th boost circuit BCj has a high current-supply capacity. The j-th boost circuit Bq having such a high current-supply capacity can become a current source for a parasitic bipolar. Thus, recovery from malfunction of the power supply can be achieved by switching the boost operation of the j-th boost circuit BCj to the low-capacity operation or stopping the boost operation of the j-th boost circuit BCj.

For example, in the power supply circuit in FIG. 10, output voltages VDDHSP, VDDRMP, VDDHSN, and VDDRMN of respective regulators RG5, RG7, RG11, and RG12 are the power supply voltages for the source driver. That is to say, the first boost circuit BC1 and the third boost circuit BC3 correspond to the j-th boost circuit BCj.

It should be noted that in the power supply circuit in FIG. 10, the second boost circuit BC2, the fourth boost circuit BC4, and the fifth boost circuit BC5 may also perform the low-capacity boost operation or stop the boost operation when malfunction of the power supply occurs.

3. Boost Circuit

Figure 4:
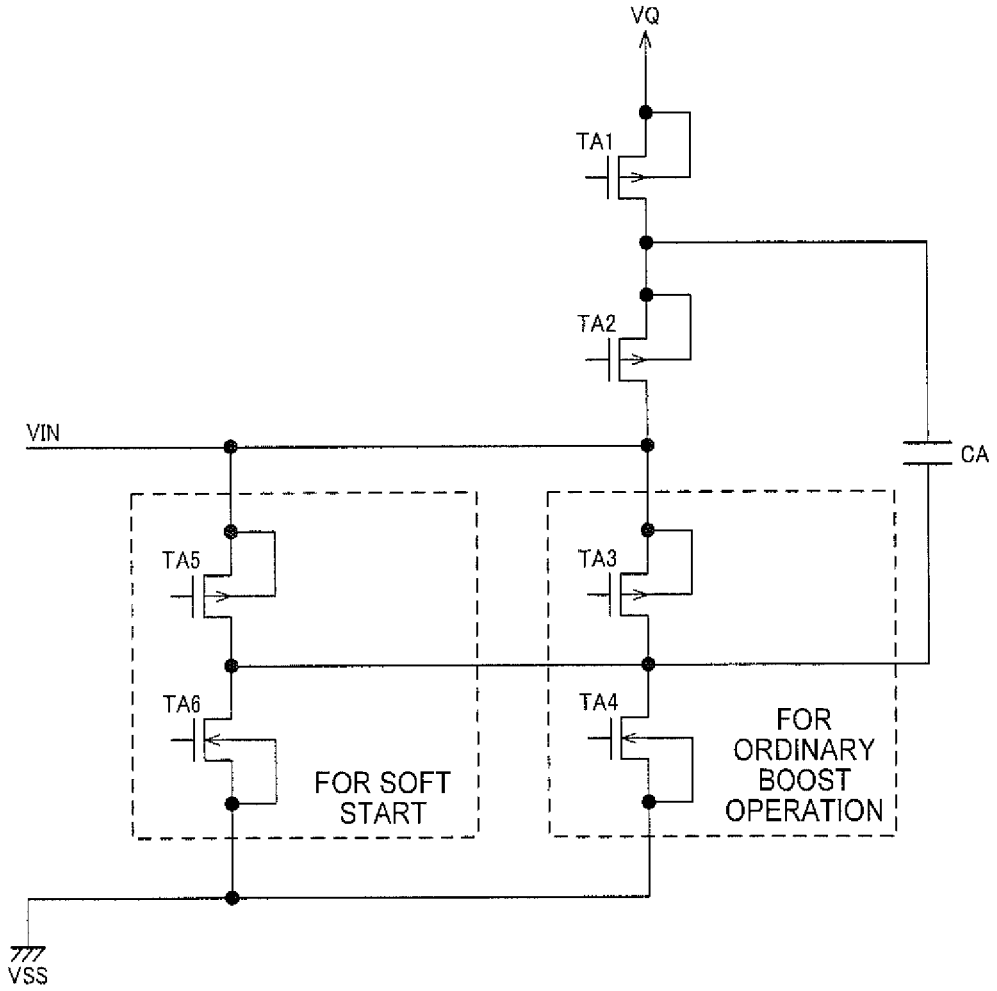
FIG. 4 shows a configuration example of a j-th boost circuit.

FIG. 4 shows a configuration example of the j-th boost circuit BCj that is capable of performing the low-capacity boost operation. FIG. 4 shows the configuration example in the case where the j-th boost circuit BCj is a charge pump circuit.

The j-th boost circuit BCj has boost transistors TA3 and TA4*a* for the ordinary boost operation as well as boost transistors TA5 and TA6 for soft start. In the low-capacity boost operation, the boost operation is performed using the boost transistors TA5 and TA6 for soft start.

More specifically, the j-th boost circuit BCj includes first to fourth transistors TA1 to TA4 that are connected in series as well as fifth and sixth transistors TA5 and TA6 that are connected to the third and fourth transistors TA3 and TA4 in parallel. In the ordinary boost operation, the boost operation is performed by turning on and off the first to fourth transistors TA1 to TA4. In the low-capacity boost operation, the third and fourth transistors TA3 and TA4 are turned off, and soft start of the boost operation is performed using the first and second transistors TA1 and TA2 as well as the fifth and sixth transistors TA5 and TA6.

The transistors TA1 to TA3 and TA5 are P-type transistors, and the transistors TA4 and TA6 are N-type transistors. In the ordinary boost operation, during a first period of time (first phase), the transistors TA2 and TA4 are turned on, the transistors TA1 and TA3 are turned off, one end of the capacitor CA is connected to a ground voltage VSS, and the other end of a capacitor CA is connected to an input voltage VIN. During a second period of time (second phase), the transistors TA2 and TA4 are turned off, the transistors TA1 and TA3 are turned on, one end of the capacitor CA is connected to the input voltage VIN, and an output voltage $VQ=2 \times VIN$ is output from the other end of the capacitor CA via the transistor TA1. The transistors TA5 and TA6 are turned off during both of the first period of time and the second period of time. Alternatively, the transistors TA5 and TA6 for soft start may also be used in the ordinary boost operation. That is to say, it is also possible that during the first period of time, the transistor TA6 is turned on and the transistor TA5 is turned off, and during the second period of time, the transistor TA5 is turned on and the transistor TA6 is turned off. In the low-capacity boost operation, during the first period of time, the transistors TA2 and TA6 are turned on and the transistors TA1 and TA5 are turned off, and during the second period of time, the transistors TA2 and TA6 are turned off and the transistors TA1 and TA5 are turned on.

The size (e.g., channel width W of channel width 1N/channel length L, or the like) of the boost transistors TA5 and TA6 for soft start is smaller than the size of the boost transistors TA3 and TA4 for the ordinary boost operation. Accordingly, the boost transistors TA5 and TA6 for soft start have the larger on-resistance, and when the boost operation is performed using those transistors TA5 and TA6, the current-supply capacity of the j-th boost circuit BCj decreases. The boost transistors TA5 and TA6 for soft start are provided to suppress the inrush current when the boost operation is started at the start-up of the power supply circuit 110. The use of such an originally provided soft start circuit enables the low-capacity boost operation to be performed when malfunction of the power supply occurs.

4. Fourth and Fifth Configuration Examples

Figure 5A:
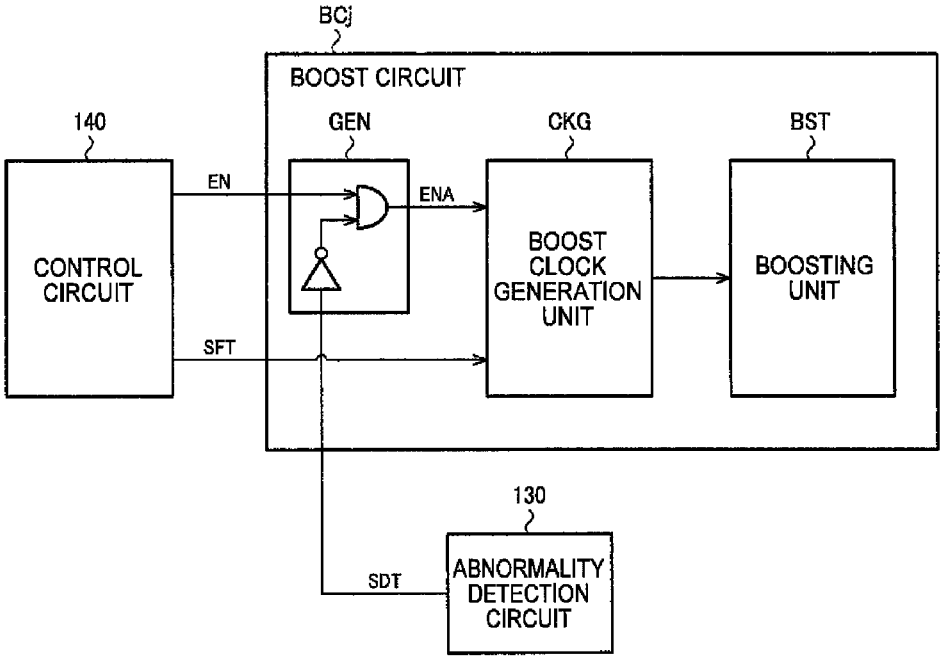
FIG. 5A shows a fourth configuration example of the driver.

FIG. 5A shows a fourth configuration example of the driver 100. The fourth configuration example is a configuration example in the case where the j-th boost circuit BCj stops the boost operation when malfunction of the power supply occurs. It should be noted that the drive circuit 120 and a part of the boost circuits are not shown in FIG. 5A.

The driver 100 includes a control circuit 140, the j-th boost circuit BCj, and the abnormality detection circuit 130. The j-th boost circuit BCj includes an enable signal generation unit GEN, a boost clock generation unit CKG, and a boosting unit BST.

The boosting unit BST is configured by the charge pump circuit that has been described with reference to FIG. 4. The boost clock generation unit CKG generates a clock signal for driving the boosting unit BST. That is to say, the boost clock generation unit CKG generates a clock signal for performing on-off control of the transistors TA1 to TA6, which constitute the boosting unit BST, in accordance with the ordinary boost operation or the soft start operation (low-capacity boost operation).

The control circuit 140 outputs an enable signal EN and a soft start signal SFT to the j-th boost circuit BCj. The j-th boost circuit BCj performs the boost operation during a period of time for which the enable signal EN is active, and performs the soft start operation during a period of time for which the soft start signal SFT is active.

The enable signal generation unit GEN generates a new enable signal ENA based on the enable signal EN from the control circuit 140 and a detection signal SDT from the abnormality detection circuit 130. When the enable signal EN is active, if the abnormality detection circuit 130 detects an abnormality of the i-th boosted voltage VBi, and the detection signal SDT thus becomes active, the enable signal generation unit GEN outputs an inactive enable signal ENA. That is to say, when malfunction of the power supply occurs, the j-th boost circuit BCj is instructed to stop the boost operation. For example, in the case where the enable signal EN and the detection signal SDT are high active, the enable signal generation unit GEN is constituted by an inverter that performs a logical inversion of the detection signal SDT and an AND circuit that outputs the logical AND of the output of the inverter and the enable signal EN.

Figure 5B:
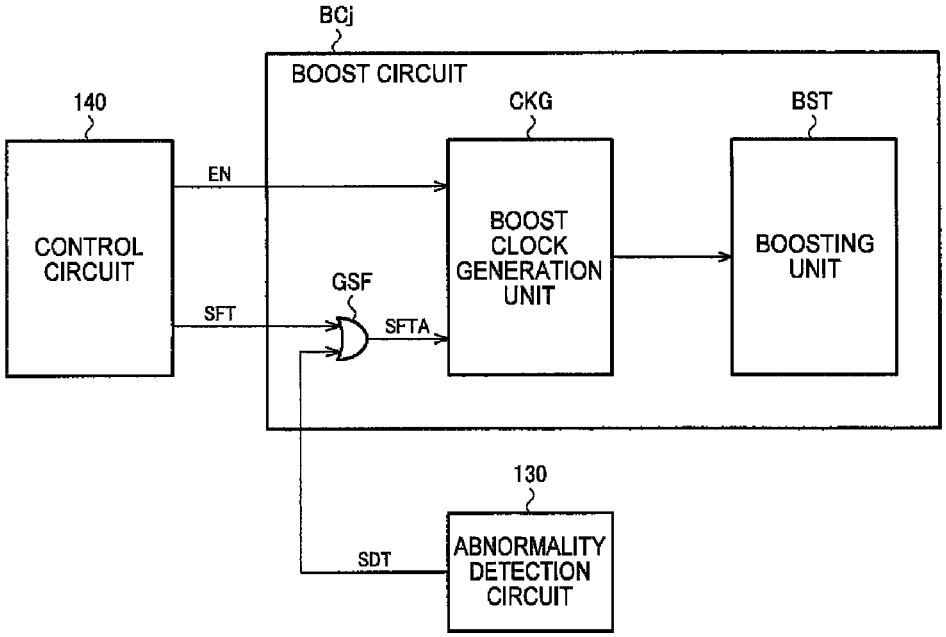
FIG. 5B shows a fifth configuration example of the driver.

FIG. 5B shows a fifth configuration example of the driver 100. The fifth configuration example is a configuration example in the case where the j-th boost circuit BCj performs the low-capacity boost operation when malfunction of the power supply occurs. It should be noted that the drive circuit 120 and a part of the boost circuits are not shown in FIG. 5B.

The driver 100 includes the control circuit 140, the j-th boost circuit BCj, and the abnormality detection circuit 130. The j-th boost circuit BCj includes a soft start signal generation unit GSF, the boost clock generation unit CKG, and the boosting unit BST.

The soft start signal generation unit GSF generates a new soft start signal SFTA based on the soft start signal SFT from the control circuit 140 and the detection signal SDT from the abnormality detection circuit 130. When the soft start signal SFT is inactive, if the abnormality detection circuit 130 detects an abnormality of the i-th boosted voltage VBi, and the detection signal SDT thus becomes active, the soft start signal generation unit GSF outputs an active soft start signal SFTA. That is to say, when malfunction of the power supply occurs, the j-th boost circuit BCj is instructed to perform the soft start operation (low-capacity boost operation). For example, in the case where the soft start signal SFT and the detection signal SDT are high active, the enable signal generation unit GEN is constituted by an OR circuit that outputs the logical OR of the detection signal SDT and the soft start signal SFT.

5. Modification

Figure 6:
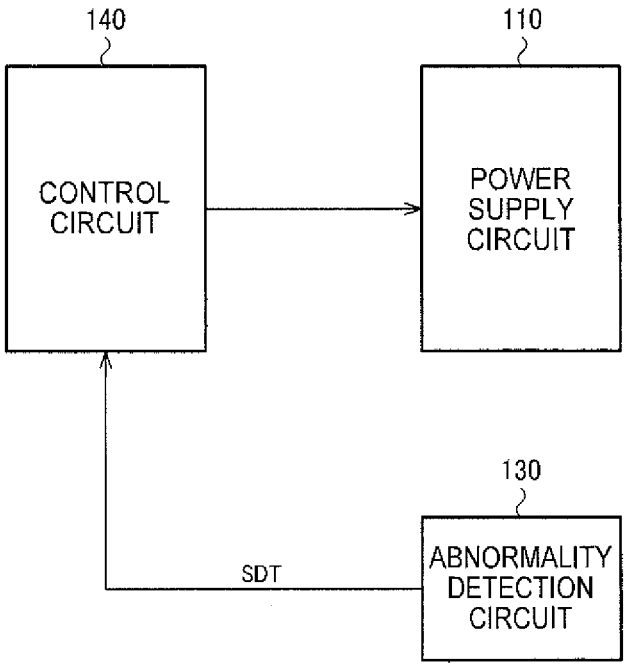
FIG. 6 shows a modification of the driver.

FIG. 6 shows a modification of the driver 100. According to this modification, if an abnormality of a boosted voltage (i-th boosted voltage VBi) is detected, a start-up sequence of the power supply circuit 110 is re-executed.

Specifically, the abnormality detection circuit 130 outputs the detection signal SDT to the control circuit 140. If the detection signal SDT becomes active, the control circuit 140 temporarily stops the operation of the power supply circuit 110 and then restarts the power supply circuit 110. The start-up sequence is a sequence for controlling the operation timing of the various units of the power supply circuit 110. As will be described later with reference to FIG. 12, the start-up sequence controls the timings at which the boost operations of the first to n-th boost circuits BC1 to BCn are started, the timings at which soft start is started and stopped, the timings at which the operations of the regulators are started (or the outputs thereof are enabled), and the like, for example.

In this manner, self-recovery from malfunction of the power supply can be achieved not only by performing the low-capacity boost operation or stopping the boost operation, but also by re-executing the start-up sequence. That is to say, re-execution of the start-up sequence causes the power supply circuit including the boost circuits to temporarily stop the operation, and the current is thus no longer supplied to the parasitic transistor, so that recovery from the malfunction of the power supply is possible.

6. Abnormality Detection Circuit

Figure 7:
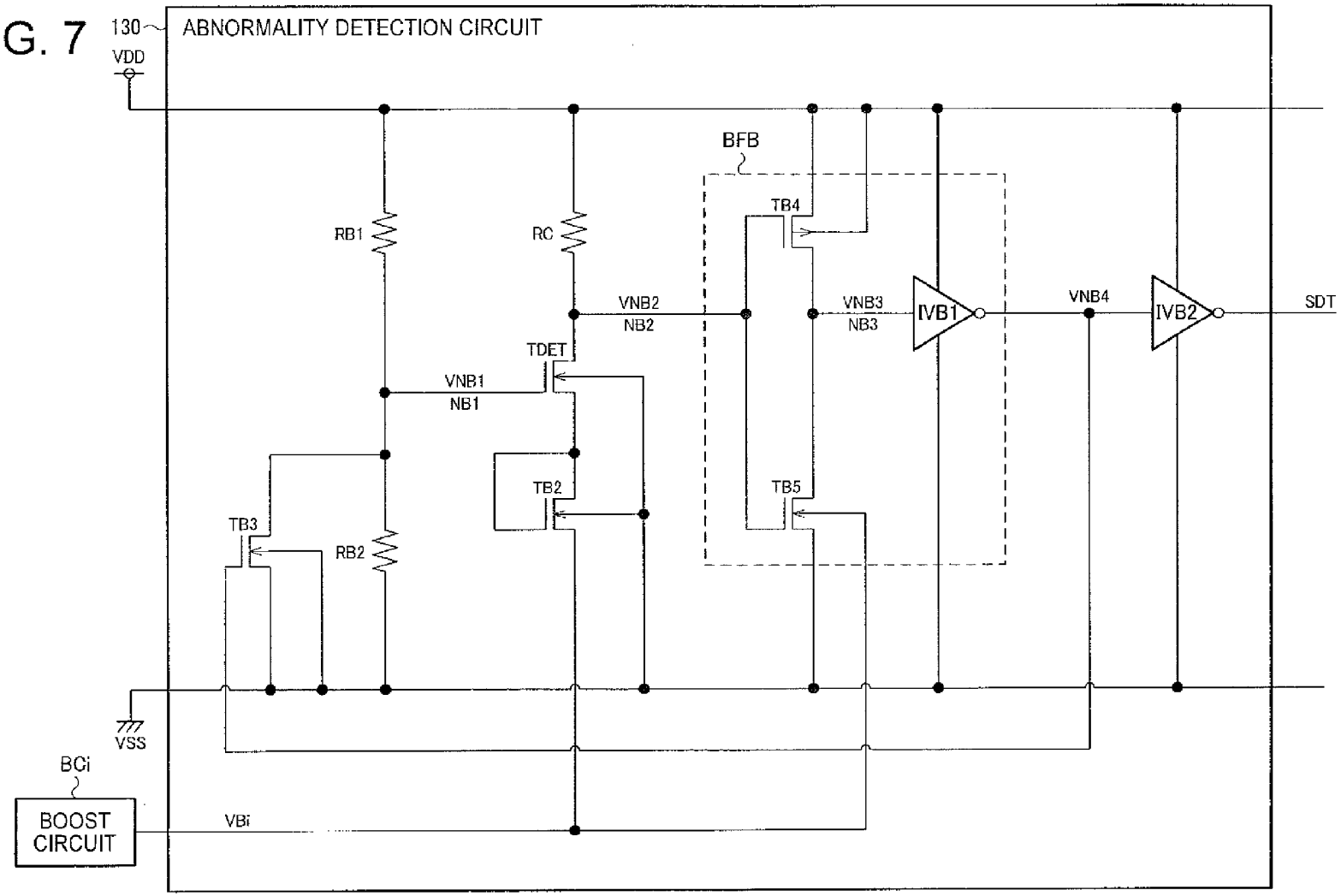
FIG. 7 shows a detailed first configuration example of an abnormality detection circuit.

FIG. 7 shows a detailed first configuration example of the abnormality detection circuit 130. As shown in FIG. 7, the abnormality detection circuit 130 has a detection transistor TDET. The detection transistor TDET is provided between a node for a first power supply voltage that is one of the high potential-side power supply voltage VDD and the low potential-side power supply voltage VSS and a node for the i-th boosted voltage VBi, and an input voltage VNB1 based on a second power supply voltage that is the other of the high potential-side power supply voltage VDD and the low potential-side power supply voltage VSS is input to the gate of the detection transistor TDET. The abnormality detection circuit 130 detects an abnormality of the i-th boosted voltage VBi based on a voltage change at one of the source and the drain of the detection transistor TDET.

It should be noted that in the following description, a case where the detection transistor TDET is an N-type transistor, the first power supply voltage is the high potential-side power supply voltage VDD, the second power supply voltage is the low potential-side power supply voltage VSS, and the abnormality detection circuit 130 detects an abnormality based on a voltage change at the drain (node NB2) of the detection transistor TDET is used as an example.

The high potential-side power supply voltage VDD and the low potential-side power supply voltage VSS are not voltages generated by the power supply circuit 110 but are power supply voltages supplied from, for example, a system power supply outside the driver 100. That is to say, the, power supply voltages VDD and VSS do not change even when an abnormality of the i-th boosted voltage VBi occurs, and are therefore reliable voltages that can be considered to be constant.

Providing the detection transistor TDET between the node for the reliable first power supply voltage VDD and the node for the i-th boosted voltage VBi and inputting the input voltage VNB1 based on the reliable second power supply voltage VSS to the gate of the detection transistor TDET allows accurate detection of an abnormality of the i-th boosted voltage VBi. That is to say, since the first power supply voltage VDD and the second power supply voltage VSS do not change, a change in a drain voltage VNB2 of the detection transistor TDET is caused by a change in the i-th boosted voltage VBi. That is to say, an abnormality of the i-th boosted voltage VBi can be detected by detecting the change in the drain voltage VNB2 of the detection transistor TDET.

Moreover, according to the present embodiment, the abnormality detection circuit 130 has a resistance element RC that is provided between the drain (one of the source and the drain) of the detection transistor TDET and the node for the first power supply voltage VDD.

That is to say, the resistance element RC and the detection transistor TDET are connected in series between the node for the first power supply voltage VDD and the node for the i-th boosted voltage VBi. Thus, the drain voltage VNB2 of the detection transistor TDET is a voltage that is resistively divided by the resistance element RC and the on-resistance of the detection transistor TDET. A change in the i-th boosted voltage VBi causes a change in the source voltage of the detection transistor TDET and hence a change in the on-resistance. This results in a change in the ratio of the resistive division, causing a change in the drain voltage VNB2 of the detection transistor TDET. Therefore, an abnormality of the i-th boosted voltage VBi can be detected.

Moreover, according to the present embodiment, the abnormality detection circuit 130 has a second transistor TB2 that is provided between the source (the other of the source and the drain) of the detection transistor and the node for the i-th boosted voltage VBi and whose drain and gate are connected to each other. For example, the second transistor TB2 is an N-type transistor.

Providing the diode-connected second transistor TB2 on the source side of the detection transistor TDET in this manner allows adjustment of the detection voltage for abnormality detection. Specifically, the i-th boosted voltage VBi is a voltage (negative voltage) lower than the second power supply voltage VSS. When malfunction of the power supply occurs, the i-th boosted voltage VBi, which is the substrate voltage, increases. However, the i-th boosted voltage VBi increases only to about the second power supply voltage VSS because a diode (parasitic diode or the like) is present between the substrate and the second power supply voltage VSS. For this reason, detection of an abnormality of the i-th boosted voltage VBi is performed using a detection voltage that is slightly lower than the second power supply voltage VSS. At this time, the detection voltage can be reduced by providing the second transistor TB2, and thus an appropriate detection voltage can be set.

The detection voltage can also be changed by changing the gate voltage of the detection transistor TDET. However, this gate voltage relates to hysteresis characteristics and cannot be changed only for adjustment of the detection voltage. For this reason, the detection voltage is adjusted by providing the second transistor TB2.

Moreover, according to the present embodiment, the abnormality detection circuit 130 detects that the i-th boosted voltage VBi is abnormal if the i-th boosted voltage VBi exceeds the detection voltage. This detection voltage has hysteresis characteristics.

Specifically, the abnormality detection circuit 130 has a buffer circuit BFB that buffers the voltage at the drain (one of the source and the drain) of the detection transistor TDET, a third transistor TB3 that is provided between the gate of the detection transistor TDET and the node for the second power supply voltage VSS and that is turned on and off based on an output (voltage VNB4) of the buffer circuit BFB, a first resistance element RB1 that is provided between a node for the first power supply voltage VDD and the gate of the detection transistor TDET, and a second resistance element RB2 that is provided between the gate of the detection transistor TDET and a node for the second power supply voltage VSS and that is connected to the third transistor TB3 in parallel.

The buffer circuit BFB is constituted by a first inverter (P-type transistor TB4 and N-type transistor TB5) that receives the drain voltage VNB2 of the detection transistor TDET and a second inverter IVB1 that receives an output of the first inverter. The abnormality detection circuit 130 includes an inverter IVB2 that receives an output of the buffer circuit BFB and outputs the detection signal SDT.

Figure 8:
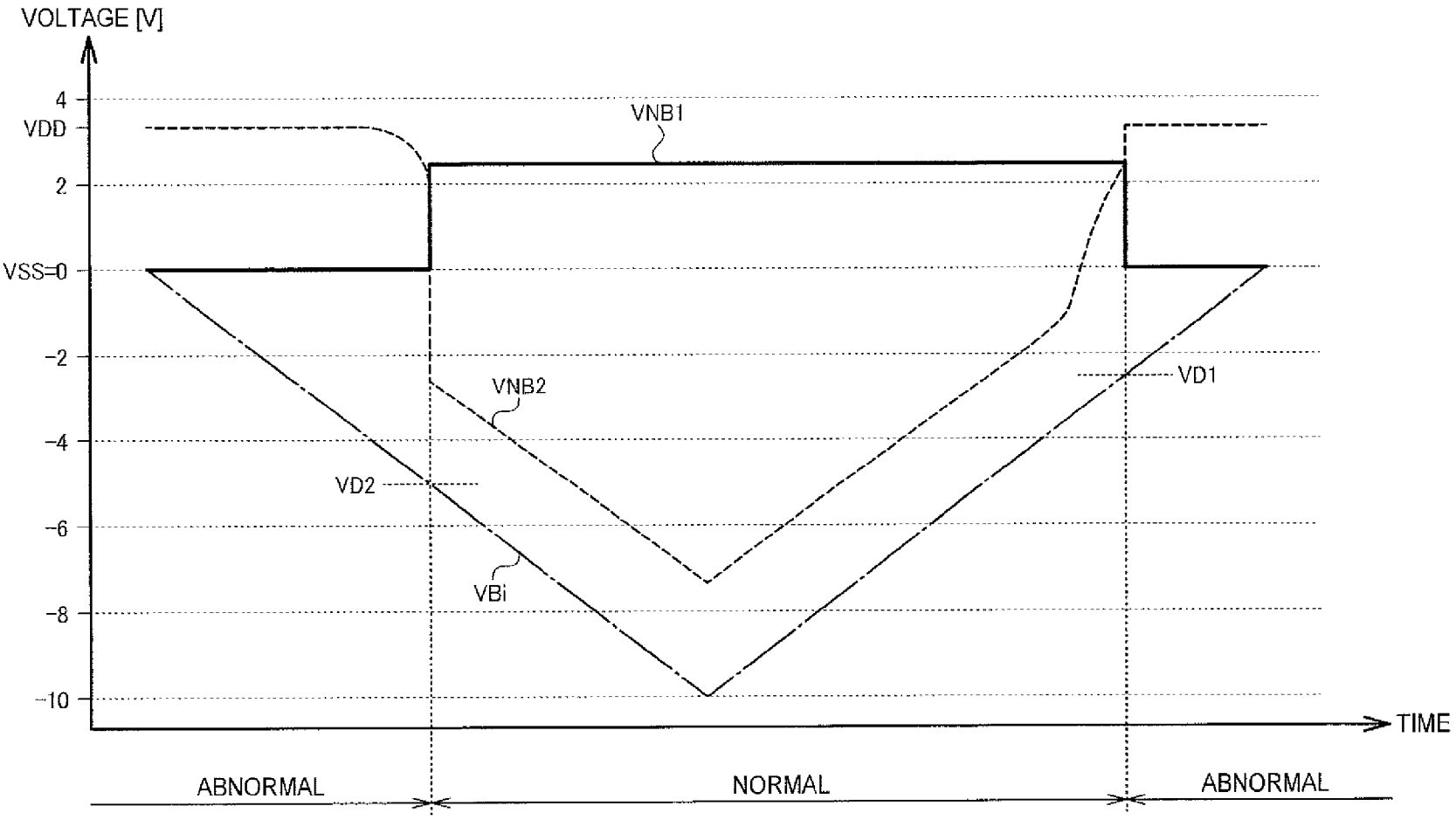
FIG. 8 is an explanatory diagram of the operation of the abnormality detection circuit.

The operation of the abnormality detection circuit 130 will be described using FIG. 8. FIG. 8 shows the simulation results of the drain voltage VNB2 and the gate voltage VNB1 of the detection transistor TDET when the i-th boosted voltage VBi was changed. For the convenience of the simulation, the i-th boosted voltage VBi was changed along the time axis.

First, the operation when the i-th boosted voltage VBi changes from normal to abnormal will be described. In a normal time, the abnormality detection circuit 130 operates with the i-th boosted voltage VBi being near −10 V. At this time, the drain voltage VNB2 of the detection transistor TDET is lower than VSS=0 V, and thus the output of the buffer circuit BFB is at a low level, and the transistor TB3 is turned off. The gate voltage VNB1 of the detection transistor TDET depends on the resistive division by the resistance elements RB1 and RB2.

When the i-th boosted voltage VBi increases from −10 V (toward the right side from the center of the paper plane), the source voltage of the detection transistor TDET increases accordingly, and thus the on-resistance of the detection transistor TDET increases. This results in an increase in the drain voltage VNB2 of the detection transistor TDET. When the i-th boosted voltage VBi reaches the detection voltage VD1, the detection transistor TDET is turned off, and the drain voltage VNB2 of the detection transistor TDET increases to the power supply voltage VDD. This causes the output of the buffer circuit BFB to change from the low level to a high level. That is to say, if the i-th boosted voltage VBi exceeds the detection voltage VD1, it is detected that the i-th boosted voltage VBi is abnormal.

Next, the operation when the i-th boosted voltage VBi recovers from abnormal to normal will be described. When the i-th boosted voltage VBi decreases from VSS=0 V (from the left side toward the center of the paper plane), the source voltage of the detection transistor TDET decreases accordingly. When the i-th boosted voltage VBi reaches the detection voltage VD2, the detection transistor TDET is turned on, and the drain voltage VNB2 of the detection transistor TDET becomes lower than VSS=0 V. This causes the output of the buffer circuit BFB to change from the high level to the low level. When the output of the buffer circuit BFB is at the high level, the transistor TB3 is turned on, and thus the gate voltage VNB1 of the detection transistor TDET is equal to VSS=0 V. This voltage is lower than the voltage divided by the resistance elements RB1 and RB2, and therefore the detection transistor TDET does not turn on until a state is reached in which the source voltage of the detection transistor TDET is even lower. That is to say, VD2<VD1, and the detection voltage has hysteresis characteristics.

Figure 9:
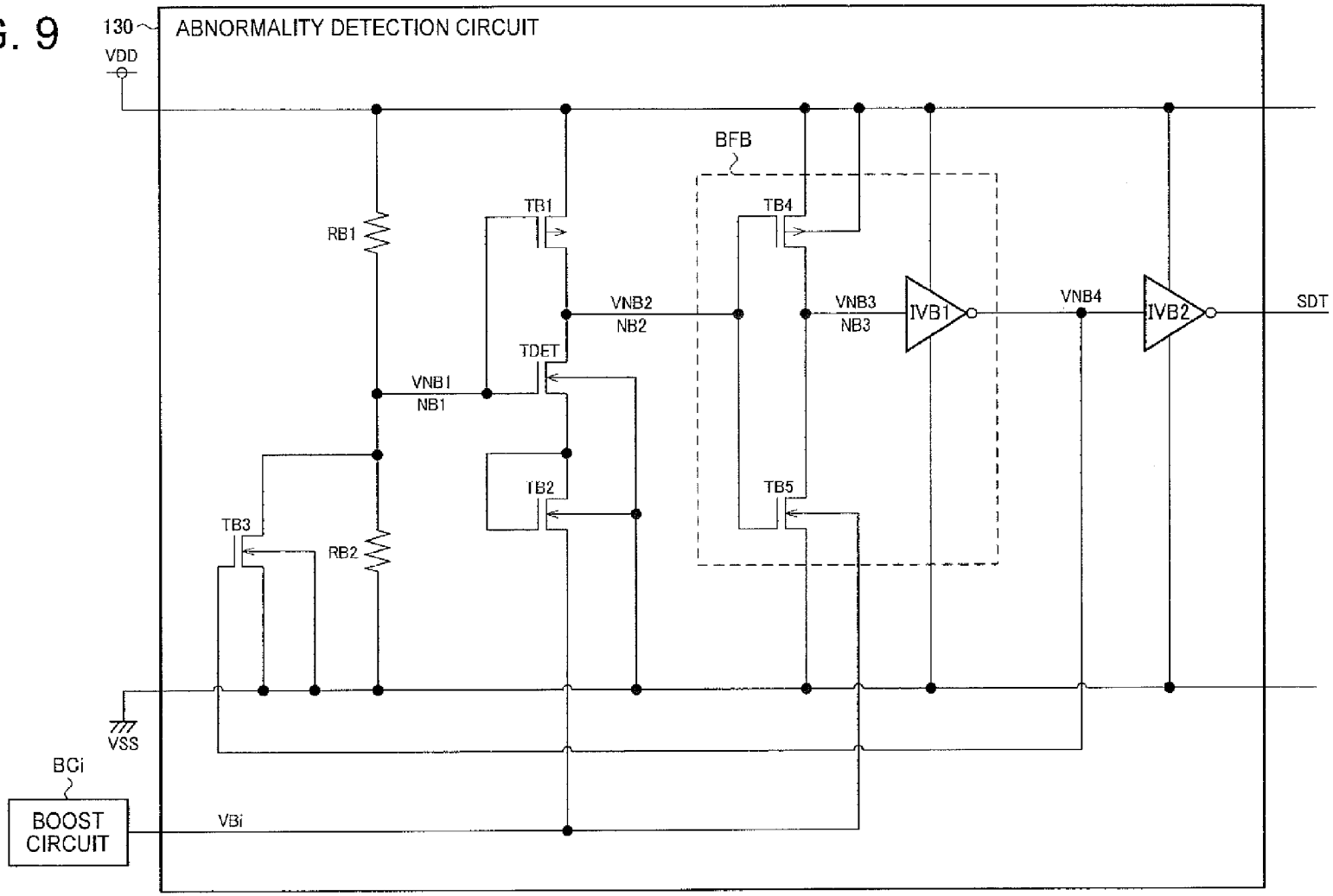
FIG. 9 shows a detailed second configuration example of the abnormality detection circuit.

FIG. 9 shows a detailed second configuration example of the abnormality detection circuit 130. In this configuration example, the abnormality detection circuit 130 has the first transistor TB1 that is provided between the drain (one of the source and the drain) of the detection transistor TDET and the node for the first power supply voltage VDD and to whose gate is input the input voltage VNB1. It should be noted that the same constitutional elements as those in the detailed first configuration example are denoted by the same reference numerals, and descriptions thereof are omitted as appropriate.

The operation is basically the same as that of the detailed first configuration example. That is to say, the on-resistance of the first transistor TB1 corresponds to the resistance element RC of the detailed first configuration example. The drain voltage VNB2 of the detection transistor TDET depends on the resistive division by the on-resistance of the first transistor TB1 and the on-resistance of the detection transistor TDET, and when the i-th boosted voltage VBi increases, and the on-resistance of the detection transistor TDET increases accordingly, the drain voltage VNB2 of the detection transistor TDET increases, thus causing an inversion of the output of the buffer circuit BFB, and therefore an abnormality is detected.

7. Power Supply Circuit

Figure 11:
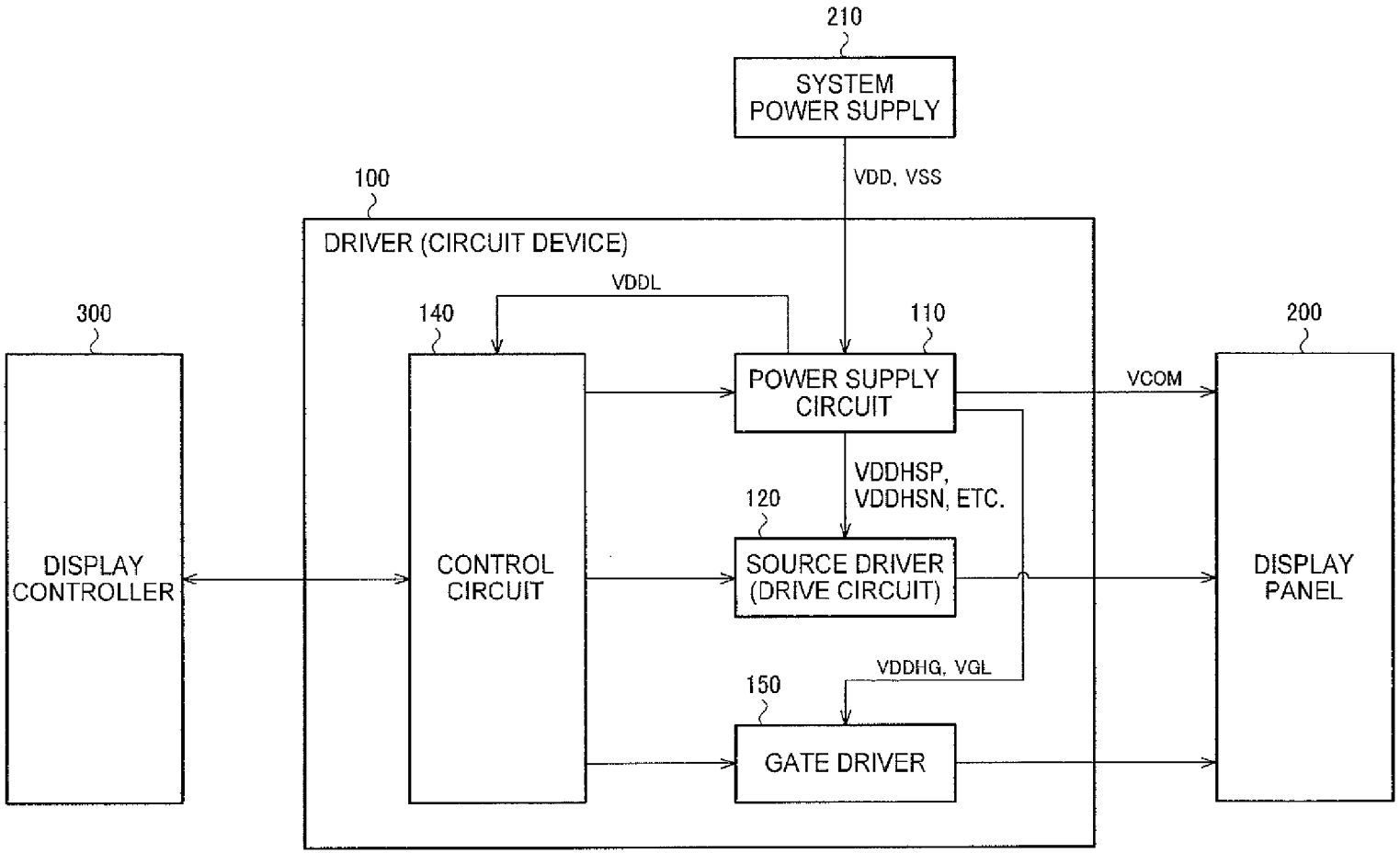
FIG. 11 shows a configuration example of the driver to which the power supply circuit is applied.

FIG. 10 shows a detailed configuration example of the power supply circuit 110. FIG. 11 shows a configuration example of the driver 100 to which the power supply circuit 110 in FIG. 10 is applied.

The driver 100 in FIG. 11 includes the power supply circuit 110, the source driver 120 (drive circuit), the gate driver 150, and the control circuit 140. The source driver 120 (data driver) is a circuit that drives the source line (data line) of the display panel 200, and includes, for example, a gradation voltage generation circuit, a D/A conversion circuit, a source amplifier, and the like. The gate driver 150 (scan driver) is a circuit that drives a gate line (scan line) of the display panel 200, and includes, for example, a level shifter, a buffer, and the like. The control circuit 140 includes, for example, an interface circuit that communicates with a display controller 300, a line latch that latches image data sent from the display controller 300, a timing controller that controls the display control timing, and the like. For example, the control circuit 140 may be configured by a gate array or the like.

The power supply circuit 110 in FIG. 10 includes first to fifth boost circuits BC1 to BC5 and first to thirteenth regulators RG1 to RG13. For example, the first to fifth boost circuits BC1 to BC5 may be charge pump circuits, and the first to thirteenth regulators RG1 to RG13 may be linear regulators. It should be noted that in FIG. 10, the positional relationship of the voltages with respect to a vertical direction in the diagram represents an approximate magnitude relationship of the voltages. For example, VDDL, VLDO1, and the like are the voltages between VDD and VSS, VOUTM, VOUT3, and the like are the voltages (negative voltages) lower than VSS, and VOUT and the like are the voltages higher than VDD.

The regulators RG1, RG2, and RG3 reduce the power supply voltage VDD to generate voltages VDDL, VLDO1, and VLDO2. As shown in FIG. 11, the voltage VDDL is the power supply voltage for the control circuit 140 (logic circuit).

The boost circuit BC1 doubles the voltage VLDO1 using the voltage VSS as the reference to generate a voltage VOUT. The regulators RG4, RG5, RG6, RG7, RG8, and RG9 reduce the voltage VOUT to generate voltages VREG, VDDHSP, VDDRHP, VDDRMP, VOFREG, and VONREG. The regulator RG4 generates the voltage VREG using an output voltage of a band gap circuit, which is not shown, as the reference. The other regulators RG1 to RG3 and RG5 to RG13 output respective voltages using the voltage VREG as the reference. As shown in FIG. 10, the voltages VDDHSP and VDDRMP are positive power supply voltages (power supply voltages used for positive electrode driving in dot inversion driving) for the source driver 120. The voltage VDDRHP is the power supply voltage for the gradation voltage generation circuit.

The boost circuit BC2 inverts the voltage VLDO2 using the voltage VSS as the reference to generate a negative voltage VOUTM. The regulator RG10 generates a voltage VCOM from the voltage VLDO2 and the voltage VOUTM. The voltage VCOM is a common voltage for use in driving the source line of the display panel 200.

The boost circuit BC3 generates a negative voltage VOUT3 whose magnitude is equal to four times of the voltage VDD using the voltage VSS as the reference by inverse boosting. The regulator RG11 reduces the voltage VOUT3 to generate a voltage VDDHSN, and the regulator RG12 reduces the voltage VDDHSN to generate a voltage VDDRMN. As shown in FIG. 10, the voltages VDDHSN and VDDRMP are negative power supply voltages (power supply voltages used for negative electrode driving in dot inversion driving) for the source driver 120.

The boost circuit BC4 generates a negative voltage VEE whose magnitude is equal to three times of the voltage VOFREG using the voltage VSS as the reference by inverse boosting. The voltage VEE is the substrate voltage of the semiconductor substrate (P-type substrate) of the driver 100. The regulator RG13 reduces the voltage VEE to generate a voltage VGL. As shown in FIG. 10, the voltage VGL is a negative power supply voltage for the gate driver 150.

The boost circuit BC5 generates a voltage VDDHG=VONREG×2−VGL from the voltage VONREG and the voltage VGL. As shown in FIG. 10, the voltage VDDHG is a positive power supply voltage for the gate driver 150.

Figure 12:
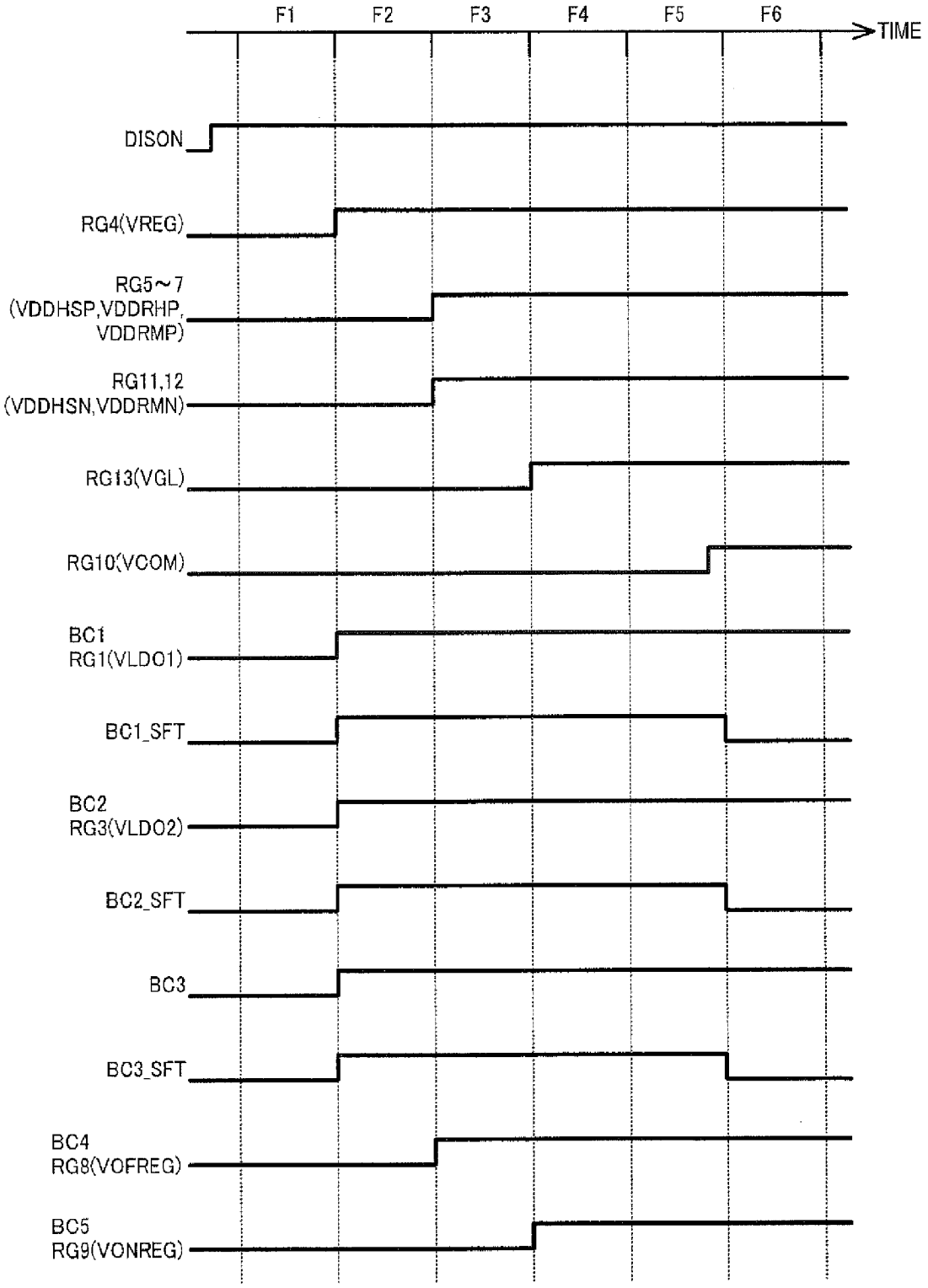
FIG. 12 shows a start-up sequence of the power supply circuit.

FIG. 12 shows a start-up sequence of the power supply circuit 110 that is executed by the control circuit 140. It should be noted that the start-up sequence is not limited to that in FIG. 12, and, for example, the boost operations of the boost circuits BC1 to BC5 may be simultaneously started. A configuration may also be adopted in which the user can set the start-up sequence by register setting, for example.

As shown in FIG. 12, if a register value DISON that instructs the start-up of the power supply circuit 110 is made active by the display controller (processing unit) outside of the driver 100, the control circuit 140 starts the start-up sequence of the power supply circuit 110. For example, the period of time for which the start-up sequence is executed may be six frames F1 to F6. It should be noted that the operation of the regulator RG1 is turned on together with the band gap circuit and the like at power-on of the driver 100.

In the start-up sequence, first, at the beginning of the second frame F2, the enable signals of the boost circuits BC1 to BC3 are made active to start the boost operations. Also, the operations of the regulators RG2 to RG4 are turned on. From the second frame F2 to the fifth frame F5, the soft start signals of the boost circuits BC1 to BC3 are kept active to cause those boost circuits to perform the soft start operations. Next, at the beginning of the third frame F3, the enable signals of the regulators RG5 to RG7, RG11, and RG12 are made active to turn on the operations thereof. Before the end of this third frame F3, primary to tertiary boost systems start up, and the reference voltage and the common voltage for the regulators as well as the power supply voltages for the source driver are output.

Moreover, at the beginning of the third frame F3, the enable signal of the regulator RG8 is made active to turn on the operation thereof, and the enable signal of the boost circuit BC4 is made active to cause this boost circuit to start the boost operation. Next, at the beginning of the fourth frame F4, the enable signal of the regulator RG13 is made active to turn on the operation thereof, the enable signal of the regulator RG9 is made active to turn on the operation thereof, and the enable signal of the boost circuit BC5 is made active to cause this boost circuit to start the boost operation. Before the end of this fourth frame F4, quaternary and quinary boost systems start up, and the power supply voltage and the substrate voltage of the gate driver are output.

Next, during the fifth frame F5 (before the beginning of the sixth frame F6), the enable signal of the regulator RG10 is made active to turn on the operation thereof. In this fifth frame F5, the common voltage is output. At the beginning of the sixth frame F6, the soft start operations of the boost circuits BC1 to BC3 are ended and shifted to the ordinary boost operations. At the end of the sixth frame F6, the start-up sequence is ended.

It should be noted that in re-execution of the start-up sequence, which has been described with reference to FIG. 6, if the detection signal SDT from the abnormality detection circuit 130 becomes active, the control circuit 140 makes the register value DISON inactive and then makes the register value DISON active again, thereby re-executing the start-up sequence.

8. Electro-Optical Device and Electronic Apparatus

Figure 13:
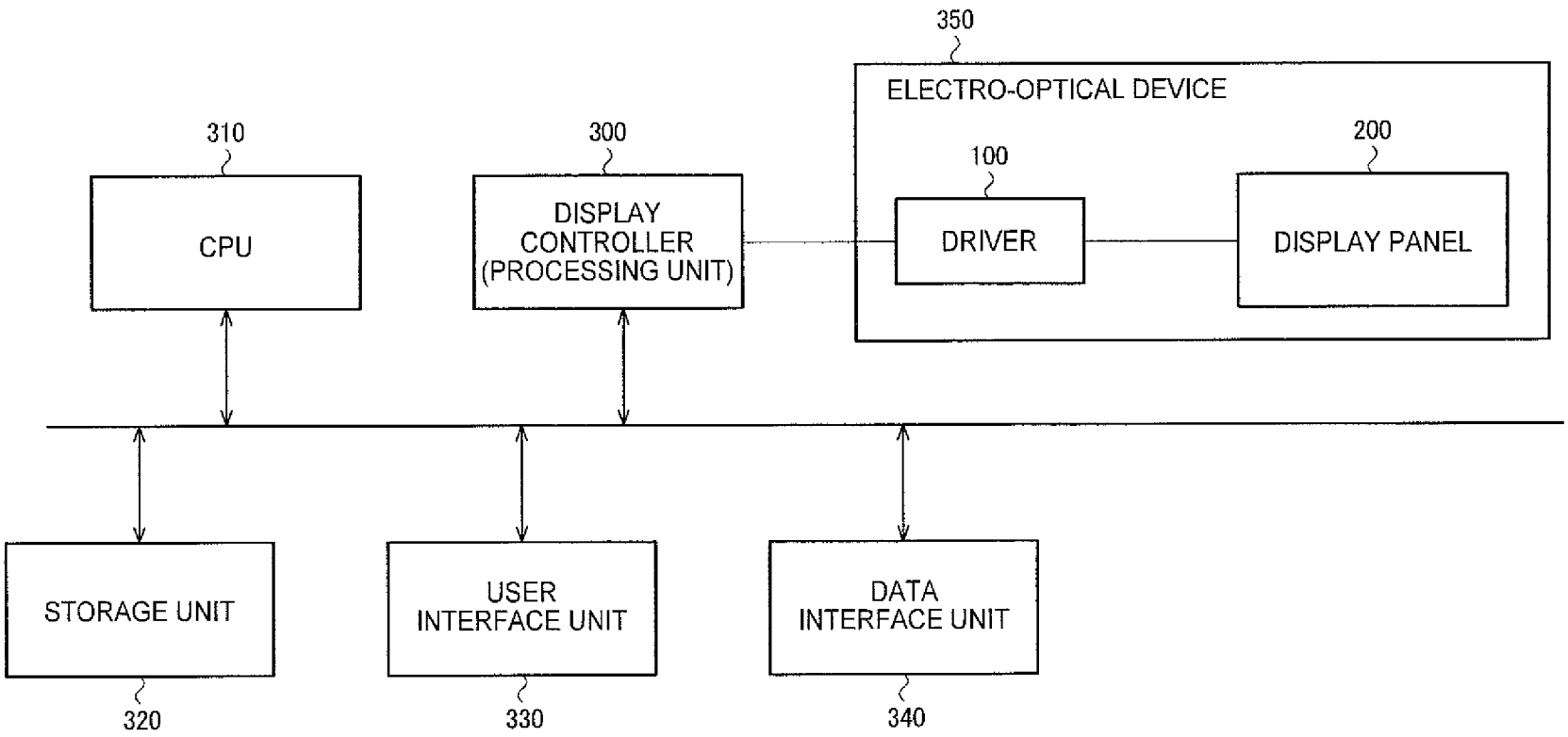
FIG. 13 shows a configuration example of an electro-optical device and an electronic apparatus.

FIG. 13 shows a configuration example of an electro-optical device and an electronic apparatus to which the driver 100 of the present embodiment can be applied. Various electronic apparatuses equipped with a display device, such as a projector, a television apparatus, an information processing apparatus (computer), a portable information terminal, a car navigation system, a portable game console, and the like, can be assumed as the electronic apparatus of the present embodiment.

An electronic apparatus shown in FIG. 13 includes an electro-optical device 350, the display controller 300 (host controller, first processing unit), a CPU 310 (second processing unit), a storage unit 320, a user interface unit 330, and a data interface unit 340. The electro-optical device 350 includes the driver 100 and the display panel 200.

The display panel 200 may be a matrix type liquid crystal display panel, for example. Alternatively, the display panel 200 may be an EL (electro-luminescence) display panel in which a self-emitting element is used. For example, a flexible substrate is connected to the display panel 200, and the driver 100 is mounted on that flexible substrate. The electro-optical device 350 is thus configured. It should be noted that a configuration may also be adopted in which the driver 100 and the display panel 200 are incorporated into an electronic apparatus as separate components without constituting the electro-optical device 350. For example, it is also possible that a flexible substrate for leading out an interconnect is connected to the display panel 200, the driver 100 is mounted on a rigid substrate together with the display controller 300 and the like, and the display panel 200 is mounted on the rigid substrate by connecting the flexible substrate to the rigid substrate.

The user interface unit 330 is an interface unit that receives various operations from the user. For example, the user interface unit 330 is configured by a button, a mouse, a keyboard, a touch panel mounted on the display panel 200, and the like. The data interface unit 340 is an interface unit that performs input and output of image data and control data. For example, the data interface unit 340 may be a wired communication interface such as an USB or a wireless communication interface such as a wireless LAN. The storage unit 320 stores the image data input from the data interface unit 340. Alternatively, the storage unit 320 functions as a working memory for the CPU 310 and the display controller 300. The CPU 310 performs processing for controlling the individual units of the electronic apparatus and various kinds of data processing. The display controller 300 performs processing for controlling the driver 100. For example, the display controller 300 converts the image data transferred from the data interface unit 340 or the storage unit 320 to a format that is acceptable to the driver 100, and outputs the converted image data to the driver 100. The driver 100 drives the display panel 200 based on the image data transferred from the display controller 300.

Although some embodiments of the invention have been described in detail above, a person skilled in the art will readily understand that various modifications may be made without substantially departing from the novel teachings and the effects of the invention. Therefore, such modifications are entirely included within the scope of the invention. For example, any term described at least once together with a broader or synonymous different term in the specification or the drawings may be replaced by the different term at any place in the specification or the drawings. Also, any combination of the foregoing embodiments and the modifications is to be included in the scope of the invention. Moreover, the configurations, operations, and the like of the power supply circuit, the abnormality detection circuit, the circuit device, the electro-optical device, and the electronic apparatus are not limited to those described in the foregoing embodiments, but may be modified in various manners.

This application claims priority from Japanese Patent Application No. 2015-028246 filed in the Japanese Patent Office on Feb. 17, 2015 the entire disclosure of which is hereby incorporated by reference in its entirely.

What is claimed is:

1. A circuit device, comprising:

a power supply circuit having first to n-th boost circuits, "n" being an integer of $n \geq 2$;

a circuit that operates based on power supplied from the power supply circuit; and an detection circuit, wherein the detection circuit detects an abnormality of an i-th boosted voltage that is generated based on a boost operation of an i-th boost circuit of the first to n-th boost circuits, "i" being an integer of $1 \leq i \leq n$, and if an abnormality of the i-th boosted voltage is detected, a j-th boost circuit of the first to n-th boost circuits performs a low-capacity boost operation with a lower current-supply capacity than an ordinary boost operation or stops the boost operation, "j" being an integer of $1 \leq j \leq n$ and $j \neq i$.

2. The circuit device according to claim 1, wherein the j-th boost circuit performs the low-capacity boost operation or stops the boost operation during a period of time for which an abnormality of the i-th boosted voltage is detected, and resumes the ordinary boost operation if the abnormality of the i-th boosted voltage is no longer detected.

3. The circuit device according to claim 1, wherein the i-th boosted voltage is a substrate voltage of the circuit device, and the detection circuit detects an abnormality of the substrate voltage.

4. The circuit device according to claim 1, wherein the j-th boost circuit is a boost circuit having a highest current-supply capacity among the first to n-th boost circuits.

5. The circuit device according to claim 1, wherein the i-th boosted voltage is a voltage that is generated based on a j-th boosted voltage that is generated based on the boost operation of the j-th boost circuit.

6. The circuit device according to claim 5, wherein the j-th boost circuit performs the low-capacity boost operation if an abnormality of the i-th boosted voltage is detected, and resumes the ordinary boost operation if the abnormality of the i-th boosted voltage is no longer detected.

7. The circuit device according to claim 1, wherein the i-th boosted voltage is a voltage that is generated based on a k-th boosted voltage that is generated based on a boost operation of a k-th boost circuit of the first to n-th boost circuits, "k" being an integer of $1 \leq k \leq n$ and $k \neq i$, j, and the j-th boost circuit stops the boost operation if an abnormality of the i-th boosted voltage is detected.

8. The circuit device according to claim 1, wherein the circuit is a drive circuit that drives a display panel based on a j-th boosted voltage that is generated based on the boost operation of the j-th boost circuit.

9. The circuit device according to claim 1, wherein the j-th boost circuit has a boost transistor for the ordinary boost operation and a boost transistor for soft start, and in the low-capacity boost operation, the j-th boost circuit performs the boost operation using the boost transistor for soft start.

10. The circuit device according to claim 1, wherein the j-th boost circuit includes first to fourth transistors that are connected in series as well as fifth and sixth transistors that are connected to the third and fourth transistors of the first to fourth transistors in parallel, and in the ordinary boost operation, the j-th boost circuit performs the boost operation by turning on and off the first to fourth transistors, and in the low-capacity boost operation, the j-th boost circuit turns off the third and fourth transistors and performs soft start of the boost operation using the first and second transistors and the fifth and sixth transistors.

11. The circuit device according to claim 1, wherein the detection circuit detects that the i-th boosted voltage is abnormal if the i-th boosted voltage exceeds a detection voltage.

12. The circuit device according to claim 11, wherein the detection voltage has hysteresis characteristics.

13. The circuit device according to claim 11, wherein the detection circuit has a detection transistor that is provided between a node for a first power supply voltage and a node for the i-th boosted voltage and to whose gate is input an input voltage based on a second power supply voltage, the first power supply voltage being one of a high potential-side power supply voltage and a low potential-side power supply voltage and the second power supply voltage being the other of the high potential-side power supply voltage and the low potential-side power supply voltage, and the detection circuit detects an abnormality of the i-th boosted voltage based on a voltage change at one of a source and a drain of the detection transistor.

14. An electro-optical device, comprising:

the circuit device according to claim 1; and a display panel, wherein the circuit is a drive circuit that drives the display panel based on the power supplied from the power supply circuit.

15. An electronic apparatus, comprising the circuit device according to claim 1.

16. A circuit device, comprising:

a power supply circuit having first to n-th boost circuits, "n" being an integer of $n \geq 2$; and a detection circuit, wherein the detection circuit detects whether an i-th boosted voltage that is generated based on a boost operation of an i-th boost circuit of the first to n-th boost circuits is within a predetermined voltage range, "i" being an integer of $1 \leq i \leq n$, and if the detection circuit detects the i-th boosted voltage is not within the predetermined voltage range, a j-th boost circuit of the first to n-th boost circuits increases an output voltage slower than a normal boost operation or stops the boost operation, "j" being an integer of $1 \leq j \leq n$ and $j \neq i$.

* * * * *